US005400992A

United States Patent [19]

Pohl

[11] Patent Number: 5,400,992

[45] Date of Patent: Mar. 28, 1995

[54] SIGNAGE CLAMP FOR RETAIL DISPLAY RACKS

[75] Inventor: Karl-Heinz Pohl, Plymouth, Minn.

[73] Assignee: Glynn Company, Inc., Minnetonka, Minn.

[21] Appl. No.: 135,159

[22] Filed: Oct. 12, 1993

[51] Int. Cl.[6] ..... A47B 96/06

[52] U.S. Cl. ..... 248/231.8; 40/606; 248/214

[58] Field of Search ..... 248/231.8, 231.4, 228, 248/214; 40/606, 607, 618; D8/73

[56] References Cited

U.S. PATENT DOCUMENTS

| | | | |
|---|---|---|---|
| D. 229,706 | 12/1973 | Lewis | D34/13 A |
| D. 342,434 | 12/1993 | Glynn | D8/73 |
| D. 342,659 | 12/1993 | Glynn | D8/73 |
| 1,473,504 | 11/1923 | Neely | 248/228 X |
| 2,437,344 | 3/1948 | Behlmann | 248/228 X |
| 2,869,812 | 1/1959 | Hamel | 248/231.8 X |
| 3,136,515 | 6/1964 | Potruch | 248/214 X |
| 3,978,610 | 9/1976 | Stubbmann | 248/231.8 X |
| 4,114,326 | 9/1978 | Macuga | 248/214 X |
| 5,257,472 | 11/1993 | Harnois | 40/606 |

FOREIGN PATENT DOCUMENTS

| | | | |
|---|---|---|---|
| 65201 | 1/1950 | Netherlands | 248/214 |

OTHER PUBLICATIONS

Glynco Plastic brochures.

*Primary Examiner*—J. Franklin Foss

*Attorney, Agent, or Firm*—Palmatier, Sjoquist & Helget

[57] ABSTRACT

A signage clamp for supporting a sign from a retail display rack having a rod has a rectangular expandable saddle-like jacket having a top wall and opposing side walls with lower edges. Each edge has at least one opposing catch with a tab extending outwardly therefrom. The jacket is guidable over the rod with the tabs forcing the catches outwardly and expanding the jacket as to capture the rod afterwhich the catches secure the jacket to the bar. The tabs may be moved apart to release the jacket from the rod. Support means are on the jacket for supporting the sign on one of the display racks at the point-of-purchase.

18 Claims, 4 Drawing Sheets

SIGNAGE CLAMP FOR RETAIL DISPLAY RACKS

BACKGROUND OF THE INVENTION

In retail stores, such as those for clothing, clothes and the like are presented to the buying public in a folded condition upon a shelf, dressed upon a mannequin or suspended from hangers. Clothing and the like on hangers are typically suspended by retail display racks which have vertical support rods or stands for supporting a horizontal rod or tube. Alternatively, retail display racks may be of a face-out bar or wall mount type which also has a horizontal rod or tube for suspending clothing on hangers therefrom and having a hanger stopper or finger at the outermost tip portion.

Signage is often highly desirable to accompany the display of clothing and the like from display racks. In the past, signage has been suspended from various structures within the retail establishment and also suitably mounted on the display racks. Signage mounted on display racks are often connected to cumbersome clamping systems which involved magnets, screws and telescoping C-clamp style clamps.

There is a need for a simple signage clamp which utilizes a minimum of parts but readily fastens to the rod of retail display racks of various sorts. Such a signage clamp should be easily assembled and easily mounted on and dismounted from the horizontal rods.

SUMMARY OF THE INVENTION

A signage clamp for supporting a sign from a retail display rack having a rod has a rectangular expandable saddle-like jacket having a top wall and opposing side walls with lower edges. Each edge has at least one opposing catch with a tab extending outwardly therefrom. The jacket is guidable over the rod with the tabs forcing the catches outwardly and expanding the jacket as to capture the rod afterwhich the catches secure the jacket to the bar. The tabs may be moved apart to release the jacket from the rod. Support means are on the jacket for supporting the sign on one of the display racks at the point-of-purchase.

A principal object and advantage of the present invention is that the signage clamp is made from a minimal number of materials and is simple to operate thereby rendering its costs significantly less than bulky and complex clamps heretofore known.

Another object and advantage of the present invention is that the signage clamp may be secured to any of a variety of retail display racks including that of vertically supported horizontal rod type racks as well as face-out bars or wall mount racks.

Another object and advantage of the present invention is that the clamp securely holds the signage in situated orientation without the fear of the sign falling over or having its orientation changed.

Another object and advantage of the present invention is that the signage clamp stays put in its desired location without fear of its improper movement as consumers move through the retail display racks to look at clothing and the like.

Other objects and advantages will become readily apparent upon review of the following figures, specification and appended claims.

DETAILED SPECIFICATION

Figure 1:
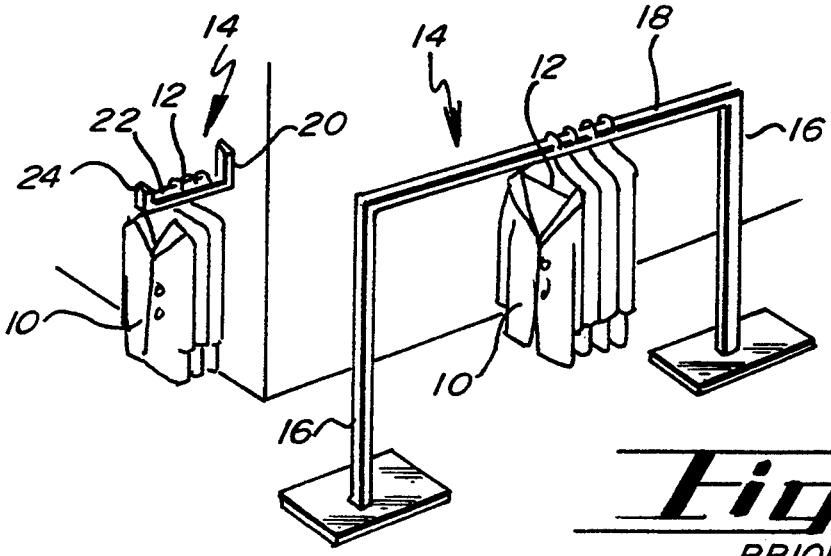
Fig. 1. PRIOR ART
FIG. 1 is a prior art perspective view of a retail establishment showing variations of retail display racks with clothing on hangers suspended therefrom.
Figure 10:
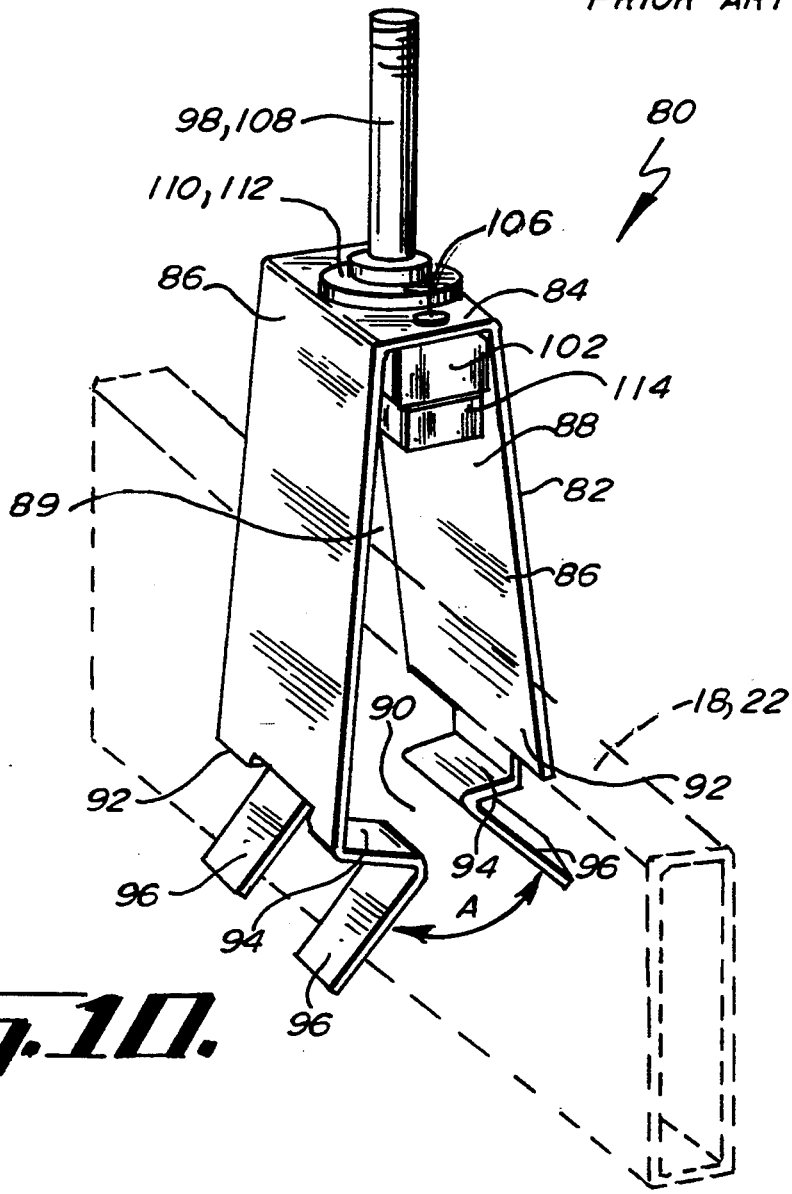
FIG. 10 is a perspective view of the second embodiment of the signage clamp partially expanded for fitting on and removal from a horizontal rod.
Figure 2:
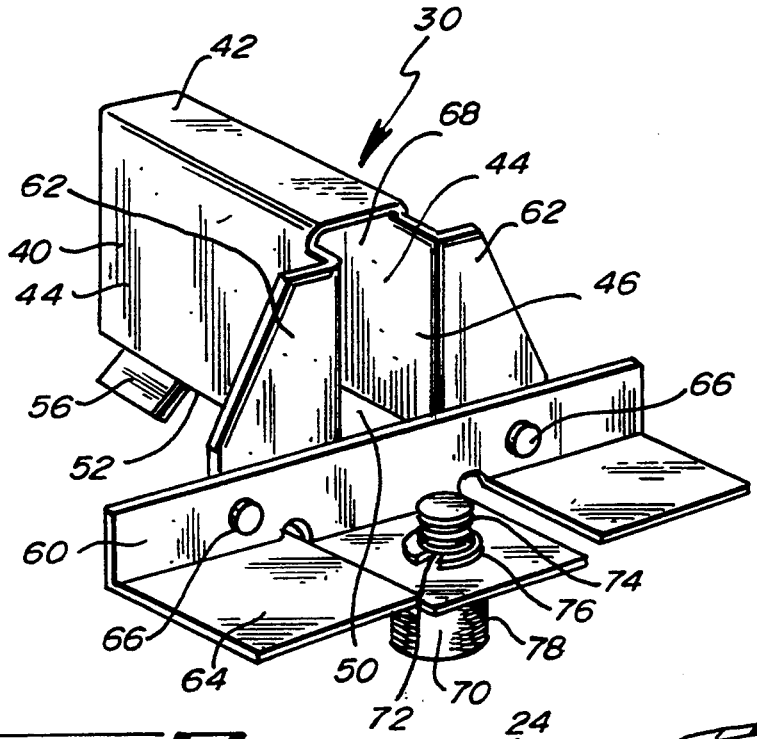
FIG. 2 is a perspective view of one of the signage clamps of the present invention.
Figure 3:
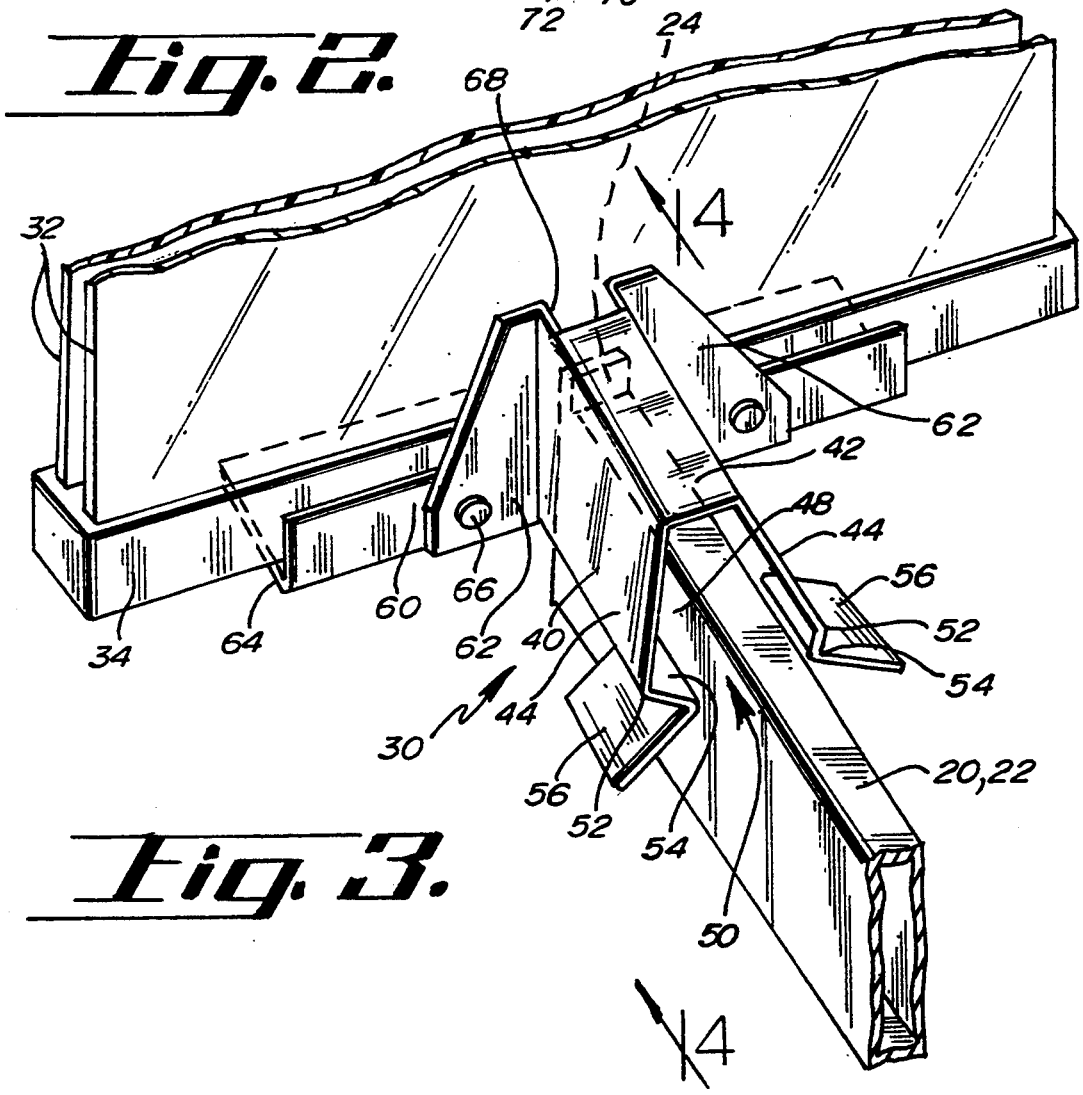
FIG. 3 is a rear perspective view of the signage clamp beginning to be mounted upon a horizontal rod of the face-out bar type wall mount with a rod and signage shown broken away.
Figure 4:
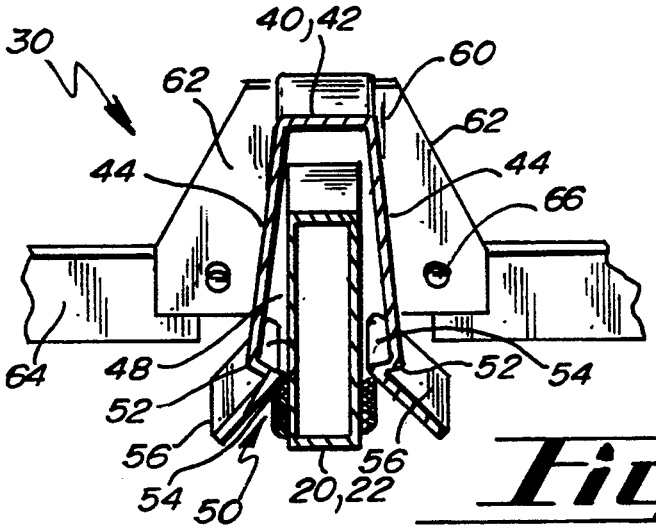
FIG. 4 is a cross-sectional view taken along lines 4—4 of FIG. 3.
Figure 5:
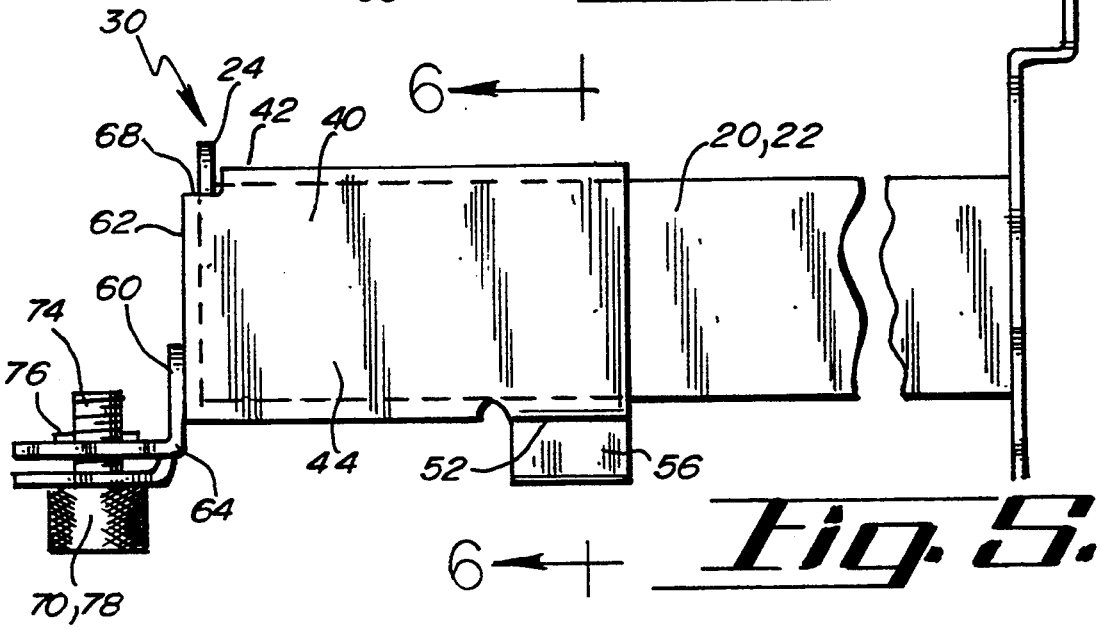
FIG. 5 is a side elevational view of the wall mount face out bar rack partially broken away supporting the secured signage clamp thereon.
Figure 6:
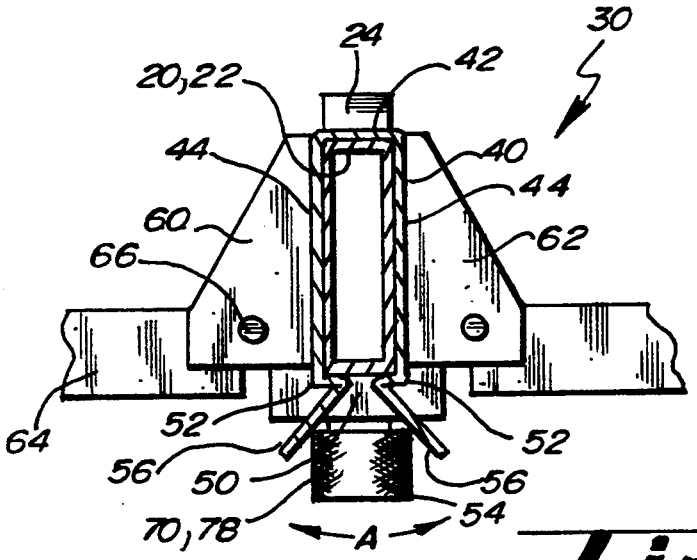
FIG. 6 is a cross-sectional view taken along lines 6—6 of FIG. 5.
Figure 7:
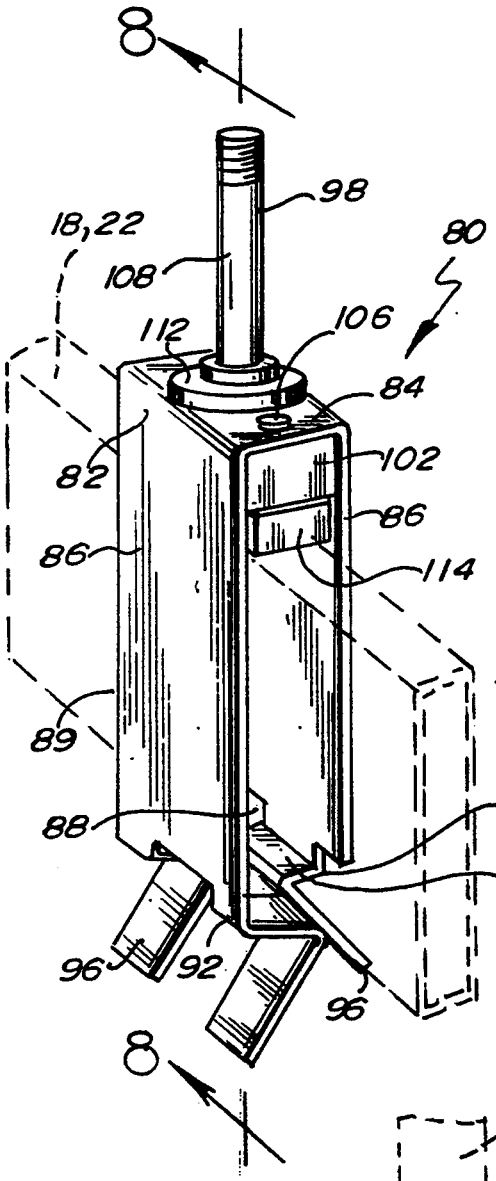
FIG. 7 is a perspective view of another signage clamp of the present invention shown mounted on a horizontal bar of a retail display rack shown in phantom outline.
Figure 9:
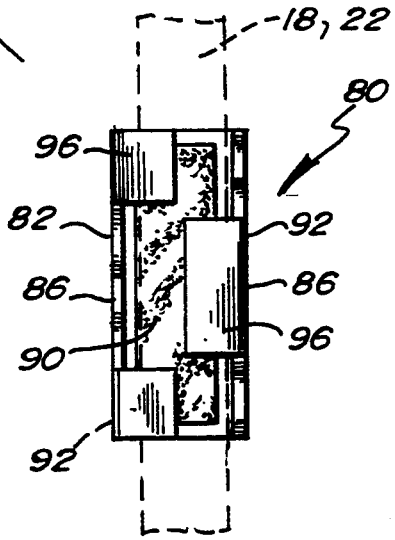
FIG. 9 is a bottom plan view of the signage clamp of the second embodiment.

Referring to FIG. 1, clothes 10 are often suspended on coat hangers 12 and then suspended from retail display racks 14 or 20. Retail display racks 14 may be supported by vertical supports or rods 16 having a horizontal rod or tube 18 that is suitably rectangular in cross-section. Another type of rack includes the wall mount rack or face-out bar 20 which also has a horizontal rod or tube 22 similar to that of rod 18. At the end of the horizontal rod 22 is located a hanger stopper or finger 24.

Figure 8:
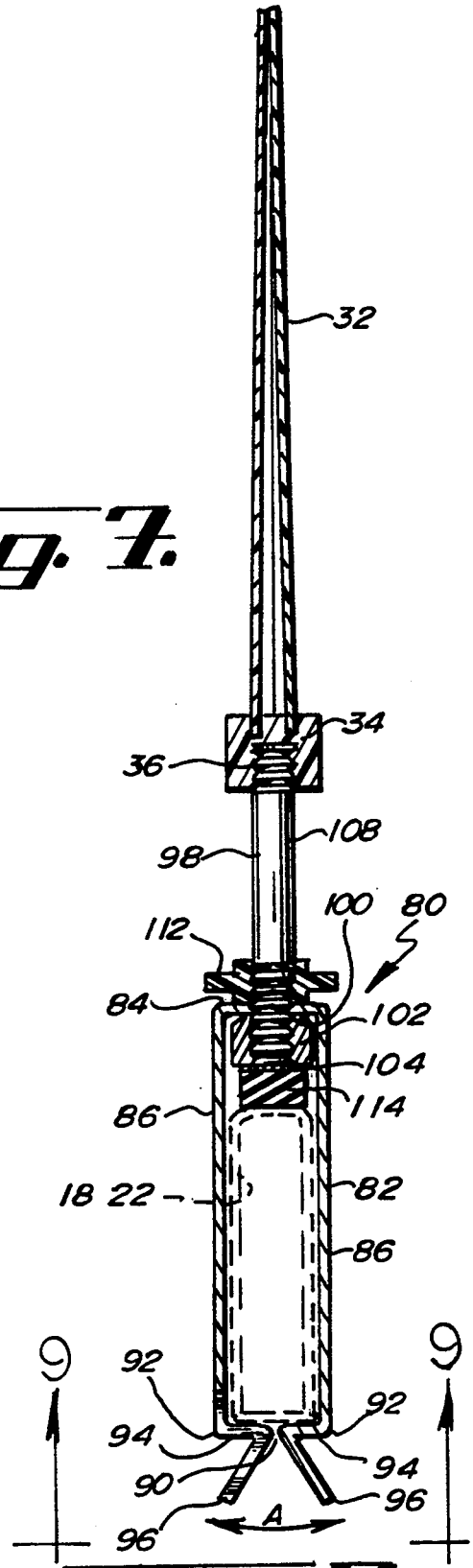
FIG. 8 is a cross-sectional view taken along lines 8—8 of FIG. 7 also showing a sign supported and secured from the clamp.

Referring to FIGS. 2–6, the signage clamp 30 of the first embodiment may be seen. Clamp 30 is appropriately utilized to support a sign 32 extending upwardly from a base 34 suitably having a threaded aperture 36 therein (see FIG. 3 and FIG. 8).

The signage clamp 30 has a rectangular expandable saddle-like jacket 40 which suitably is made of spring steel and will readily capture the horizontal rod 18. The jacket 40 has a top wall 42 and opposing side walls 44 with a front opening 46 and a rear opening 48. A bottom opening 50 is also provided whereat are located bottom edges 52 at the lowermost portions of sidewalls 44. At the bottom edges 52 are located opposing, inwardly projecting catches 54 from which downwardly and outwardly extend tabs, ears or tongues 56 which are readily grippable by the human hand.

Means 60 on the jacket are provided for supporting a sign and may include flanges 62 and a channel member 64 connected together suitably by rivets or screws 56. Channel member 64 suitably receives and supports the sign base 34. This arrangement creates receiving slot 68 for insertion of hanger stopper finger 24 thereat. Locking means 70 are also provided which generally include an aperture 72 within the channel member 64 supporting a threaded rod 74 and securing it thereat by a retaining ring. Rod 74 is rotatably adjustable by knob 78.

Initially, the sign base 34 is located into the channel member 64 and the threaded rod 74 is rotatably adjusted by knob 78 as to thread rod 74 into sign base threaded aperture 36 to secure the sign 32 securely thereto. Next, the signage clamp 30 is oriented just above the horizontal rod 22 and is lowered thereon so that the bottom opening 50 is directly thereabove. As the clamp is further lowered, the tabs 56 begin to expand the clamp 30 thereby forcing the sidewalls 44 to expand away from each other and to permit the signage clamp 30 to capture the horizontal rod 22. As soon as the catches 54 reach the bottom of the horizontal rod 22, they spring inwardly to secure the clamp 30 onto the rod 22. The removal of the clamp 30 from the rod 22 may be easily facilitated by an individual expanding the tabs 56 with the effort of fingers such as that shown along double headed arrow A in FIG. 6. Thereafter, the signage clamp 30 is rotated upwardly from the rear with the sign 32 moving downwardly to guide the catches 54 to the top of the horizontal rod 22 afterwhich the signage clamp 30 is simply lifted off of the hanger stop 24 as will be appreciated.

Referring to FIGS. 7–10, the second embodiment or signage clamp 80 may be appreciated. Again, clamp 80 supports a sign 32 with a base 34 appropriately having a threaded aperture 36 therein. Signage clamp 80 has a rectangular expandable saddle-like jacket 82 suitably made of spring steel. Clamp 80 has a top wall 84 and opposing sidewalls 86 along with front opening 88, rear opening 89 and bottom opening 90. Adjacent the bottom opening 90 are located bottom edges 92 of sidewalls 86. From the edges 92 extending inwardly are opposing catches 94 from which downwardly and outwardly extend tabs, ears or tongues 96.

The signage clamp 80 has a means 98 on the jacket 82 for supporting a sign 32. The means 98 suitably may include an aperture 100 in the top wall 84 with a block 102 suitably therebelow having a threaded aperture 104 therein and alignable with aperture 100. The block 102 is suitably secured in that position against top wall 54 by screws or rivets 106. A threaded signage support rod 108 may then be threaded into the block aperture 104 while its opposing threaded end may be threaded into the threaded aperture 36 of the sign base 34. Locking means 110 is provided to include a threaded locking ring 112 which may be adjusted to secure the exact orientation of the sign 32 with respect to the clamp 80. A rubber block 114 is appreciably provided and adhesively secure to the bottom side of block 102. Rubber block 114 prevents the signage clamp 80 from being readily moved or slid along the horizontal rod 22 or 18 as to discourage consumers from playing, moving or tampering with the sign 32. Rubber block 114 also permits clamp 80 to be securely fastened to a vertical rod as block 114 discourages sliding along any rod.

Operation of signage clamp 80 is similar to that of signage clamp 30. The clamp 80 is guided downwardly from above over the horizontal rod 18 or 22 as to orientate the bottom opening 90 directly above the rod 18 or 22. The tabs 96 then begin to engage the rod 22 and expand the opposing catches 94 and sidewalls 86 outwardly to permit the clamp 80 to be moved downwardly upon the rod 18 or 22. As the catches 94 reach the bottom of rod 18 or 22, they spring into position and secure the clamp 80 to the rod 18 or 22. Removal of the signage clamp is simply performed by the fingers spreading the tabs 96 (Arrow A, FIG. 10) and lifting the signage clamp 80 in an upward motion in reverse to that as applying the clamp 80 to the rod 18 or 22.

The present invention may be embodied in other specific forms without departing from the spirit of essential attributes thereof; therefore, the illustrated embodiment should be considered in all respects as illustrative and not restrictive, reference being made to the appended claims rather than to the foregoing description to indicate the scope of the invention.

I claim:

1. A signage clamp for supporting a sign from a retail display rack at the point-of-purchase wherein the rack has a rod rectangular in cross section typically for suspending clothing and the like from coat hangers, the clamp comprising:

(a) a rectangular expandable saddle-like jacket having a top wall and opposing sidewalls with lower edges, each edge having at least one opposing catch with a tab extending outwardly therefrom, the jacket being guidable over the rod with tabs forcing the catches outward and expanding the jacket to capture the rod afterwhich the catches secure the jacket to the bar, the tabs may be moved apart to release the jacket from the rod; and (b) support means on the jacket for supporting the sign on the display rack at the point-of-purchase.

2. The signage clamp of claim 1, wherein the means for supporting the sign comprises a flange extending from the jacket supporting a channel member for receiving and holding the sign.

3. The signage clamp of claim 2, further comprising locking means on the channel member to secure the sign to the clamp.

4. The signage clamp of claim 3, wherein the locking means comprises a rod extending from the channel member threadable into the sign.

5. The signage clamp of claim 1, wherein the means for supporting the sign comprises a signage support rod extending upward from and threaded into the jacket and threadable into the sign.

6. The signage clamp of claim 5, further comprising locking means on the support rod to secure and lock the sign into position on the clamp.

7. The signage clamp of claim 6, wherein the locking means comprises a threaded locking ring on the rod.

8. A signage clamp for supporting a sign from a retail display rack at the point-of-purchase wherein the rack has a rod rectangular in cross section typically for suspending clothing and the like from coat hangers, the clamp comprising:

(a) a rectangular expandable saddle-like jacket having a top wall and opposing sidewalls with lower edges, each edge having at least one opposing catch with a tab extending outwardly therefrom, the jacket being guidable over the rod with tabs forcing the catches outward and expanding the jacket to capture the rod afterwhich the catches secure the jacket to the bar, the tabs may be moved apart to release the jacket from the rod;

(b) support means on the jacket for supporting the sign on the display rack at the point-of-purchase; and (c) locking means for securing the sign to the clamp.

9. The signage clamp of claim 8, wherein the means for supporting the sign comprises a flange extending from the jacket supporting a channel member for receiving and holding the sign.

10. The signage clamp of claim 9, wherein the locking means comprises a rod extending from the channel member threadable into the sign.

11. The signage clamp of claim 8, wherein the means for supporting the sign comprises a signage support rod extending upward from and threaded into the jacket and threadable into the sign.

12. The signage clamp of claim 11, wherein the locking means comprises a threaded locking ring on the rod.

13. A signage clamp for supporting a sign from a retail display rack at the point-of-purchase wherein the rack has a horizontal rod rectangular in cross section typically for suspending clothing and the like from coat hangers, the clamp comprising:

(a) a rectangular expandable saddle-like jacket having a top wall and opposing sidewalls with lower edges, each edge having at least one opposing catch with a tab extending outwardly therefrom, the jacket being guidable over the rod with tabs forcing the catches outward and expanding the jacket to capture the rod afterwhich the catches secure the jacket to the bar, the tabs may be moved apart to release the jacket from the rod;

(b) means on the jacket for supporting the sign on the display rack at the point-of-purchase comprising a flange extending from the jacket supporting a channel member for receiving and holding the sign; and (c) locking means on the channel member to secure the sign to the clamp.

14. The signage clamp of claim 13, wherein the locking means comprises a rod extending from the channel member threadable into the sign.

15. A signage clamp for supporting a sign from a retail display rack at the point-of-purchase wherein the rack has a rod rectangular in cross section, the clamp comprising:

(a) a rectangular expandable saddle-like jacket having a top wall and opposing sidewalls with lower edges, each edge having at least one opposing catch with a tab extending outwardly therefrom, the jacket being guidable over the rod with tabs forcing the catches outward and expanding the jacket to capture the rod afterwhich the catches secure the jacket to the bar, the tabs may be moved apart to release the jacket from the rod;

(b) means on the jacket for supporting the sign on the display rack at the point-of-purchase comprising a signage support rod extending from and threaded into the jacket and threadable into the sign; and (c) means on the top wall of the jacket to prevent sliding movement of the clamp along the rod.

16. The signage clamp of claim 15, further comprising locking means on the support rod to secure and lock the sign into position on the clamp.

17. The signage clamp of claim 16, wherein the locking means comprises a threaded locking ring on the rod.

18. The signage clamp of claim 15, wherein the means for preventing sliding movement comprises a rubber block between the sidewalls.

* * * * *